US008490339B2

(12) United States Patent
Braunstein et al.

(10) Patent No.: US 8,490,339 B2
(45) Date of Patent: Jul. 23, 2013

(54) SUNSHADES

(75) Inventors: Richard Braunstein, Marietta, GA (US); Don Pangburn, McDonough, GA (US); Terry Carespodi, Carrollton, GA (US)

(73) Assignee: YKK Corporation of America

( * ) Notice: Subject to any disclaimer, the term of this patent is extended or adjusted under 35 U.S.C. 154(b) by 473 days.

(21) Appl. No.: 12/624,014

(22) Filed: Nov. 23, 2009

(65) Prior Publication Data

US 2010/0065225 A1 Mar. 18, 2010

Related U.S. Application Data

(60) Division of application No. 11/820,376, filed on Jun. 19, 2007, now Pat. No. 7,849,638, which is a continuation-in-part of application No. 11/524,976, filed on Sep. 21, 2006, now Pat. No. 7,600,350.

(51) Int. Cl.
*E04B 1/34* (2006.01)

(52) U.S. Cl.
USPC ..... 52/74; 52/582.1; 52/582.6

(58) Field of Classification Search
USPC .. 52/74, 75, 76, 77, 78, 582.1, 586.1; 160/47, 160/54, 61, 45
See application file for complete search history.

(56) References Cited

U.S. PATENT DOCUMENTS

| | | | |
|---|---|---|---|
| 205,064 | A | 6/1878 | Doolittle |
| 2,900,681 | A | 8/1959 | Becker |
| 3,204,324 | A | 9/1965 | Nilsen |
| 3,367,077 | A | 2/1968 | Johnston |
| 3,388,510 | A | 6/1968 | Smith et al. |
| 3,729,874 | A | 5/1973 | Albany |
| 3,823,524 | A | 7/1974 | Weinstein |
| 3,956,863 | A | 5/1976 | Tiedeken |
| 4,231,207 | A | 11/1980 | Kern et al. |
| 4,418,506 | A | 12/1983 | Weber et al. |
| 4,463,540 | A | 8/1984 | Gordon |
| 4,650,702 | A | 3/1987 | Whitmyer |
| 4,680,905 | A | 7/1987 | Rockar |
| 4,938,445 | A | 7/1990 | Medley |
| 5,299,395 | A | 4/1994 | Smith et al. |
| 5,355,645 | A | 10/1994 | Farag |
| 5,592,794 | A | 1/1997 | Tundaun |
| 6,167,897 | B1 | 1/2001 | Resso et al. |
| 6,421,966 | B1 | 7/2002 | Braunstein et al. |
| 6,550,196 | B2 | 4/2003 | Braybrook |
| 6,745,538 | B1 | 6/2004 | Marinoni |
| 6,889,474 | B2 | 5/2005 | Wesdock |
| 7,165,367 | B2 | 1/2007 | Habicht |

(Continued)

OTHER PUBLICATIONS

*1600 SunShade*; Kawneer (An Alcoa Company); Kawneer Company, Inc. 2002; pp. 1-7.

*Primary Examiner* — Branon Painter
(74) *Attorney, Agent, or Firm* — Alston & Bird LLP

(57) ABSTRACT

A sunshade for mounting to a building structure has first and second extruded outriggers spaced apart from each other and louvers extending from the first outrigger to the second outrigger. The first and second outriggers have an elongated body, an upper leg extending from an upper portion of the elongated body, and a lower leg extending from a lower portion of the elongated body. The outriggers of adjacent sunshades face each other such that the upper legs face each other and the lower legs face each other. A pocket is formed between the adjacent outriggers. The outriggers also have a mounting notch at an end which is mounted to the building structure. The outrigger notch engages a hook on a sunshade anchor mounted to the building structure.

16 Claims, 11 Drawing Sheets

U.S. PATENT DOCUMENTS

| | | | |
|---|---|---|---|
| 7,536,832 | B2 | 5/2009 | DeYoung |
| 2002/0108323 | A1 | 8/2002 | Gruber |
| 2004/0123550 | A1 | 7/2004 | Hartman |
| 2005/0284053 | A1 | 12/2005 | Grunewald et al. |
| 2008/0098665 | A1 | 5/2008 | DeYoung |

SUNSHADES

CROSS-REFERENCE TO RELATED APPLICATIONS

This application is a divisional of copending U.S. application Ser. No. 11/820,376, filed Jun. 19, 2007, which is a continuation-in-part of U.S. application Ser. No. 11/524,976, filed Sep. 21, 2006, which has now issued as U.S. Pat. No. 7,600,350 on Oct. 13, 2009, all of which are hereby incorporated herein in their entirety by reference.

BACKGROUND OF THE INVENTION

The copending parent application Ser. No. 11/524,976, includes embodiments which pertain to thermally broken sunshade anchors that mount sunshades to building curtain walls, embodiments which pertain to sunshades, and other embodiments as well. Embodiments of the present invention also pertain to sunshades, including sunshades of the parent application and other sunshades. In embodiments of the present invention, sunshades can be mounted to building curtain walls using the thermally broken sunshade anchors of the parent application. Embodiments of the present invention are not limited to use with building certain walls and can be used with other building framing systems and other structural supports. The present invention also pertains to methods related to sunshades, including methods of installing sunshades.

Sunshades are often used on the outside of commercial architectural projects or buildings to shade large expanses of glass from sunlight. The sunshades are attached to the exteriors of the buildings and extend outward away from the buildings. The sunshades have louvers which reduce the amount of sunlight that reaches the buildings. The sunshades can mitigate possible solar heat gain to the inside of the buildings from solar light passing through the glass. The energy efficiency and performance of buildings is a concern, due to, for example, rising energy costs and environmental concerns associated with non-renewable energy sources. Architects are specifying products like sunshades to improve the overall energy efficiency and performance of the buildings they design. In many cases, architects are designing curtain wall systems where sunshades are directly integrated into the structural members of the curtain wall (known as mullions).

Many commercial sunshades that currently attach to curtain walls are made of discrete components that are pre-assembled in a controlled environment (such as a contractor's workshop) through the use of screw spline joinery methods. The pre-assembled sunshades are delivered to a construction site where they are installed onto the curtain wall structure. The process of installing a plurality of sunshades in a sunshade array is usually conducted sequentially where a first pre-assembled sunshade unit is attached to two mullions and then a second pre-assembled sunshade unit is attached to one of the same two mullions plus a third mullion and so on. An attachment device, known as an anchor clip, is usually pre-located on each mullion to receive the pre-assembled sunshade unit. Typically the pre-assembled sunshade has extension components, known as outriggers, which are attached to the anchor clips to mount the sunshade unit to the curtain wall structure. The outriggers are typically made of steel plate or aluminum plate. Often, some material is used to function as a "spacer" between each sunshade unit at the anchor clip in order to facilitate tightening the pair of outriggers to the anchor clip. In many cases the curtain wall component that attaches to the mullion designed to retain the glass, known as the pressure plate, must be machined in order to mount these sunshade components. All of this is fairly common in the art of attaching sunshades to curtain wall structures.

Sunshades and techniques for attaching sunshades directly to curtain wall structures have problems and can be improved and simplified.

For example, existing sunshade outriggers are made of plate material which can cause problems or difficulties. When outriggers made of plate material are joined by fasteners to louver blades and/or fascia elements to construct the basic sunshade unit, the fasteners are exposed. Also, when sunshades with plate type outriggers are attached onto a channel type anchor clip, a spacer must be placed between the pairs of outriggers of adjacent sunshades to facilitate fastening the sunshade units to the anchor clip. The spacer can be difficult to handle and maintain in proper position during installation.

Each pair of adjacent sunshades are typically aligned with each other at the conclusion of the installation process for each pair of adjacent sunshades. The alignment is usually accomplished by making visual adjustments to the alignment while tightening the bolts that fasten the outriggers to the anchor clip. Plate style outriggers tend to easily slip or slide relative to each other which makes the alignment process difficult. Also, the sunshades may slip relative to each other over time and become misaligned.

The end sunshade may be "capped off" with a blank outrigger to conceal the fasteners of the last sunshade unit and to create a consistent look across the sunshade array. Although the last blank outrigger is attached to the anchor clip in the same manner as the outriggers of the sunshades, the last blank outrigger can act like a "sail" and undesirably move in the wind if not mechanically fastened at its free end to the adjacent outrigger.

Sunshades or sunshade components can be anodized to provide a desired color. However, outriggers made from aluminum plate have a different aluminum alloy than the other sunshade components, such as extruded aluminum louvers and fascia. Anodized aluminum plate outriggers can not be anodized to match the other anodized extruded aluminum components. However, embodiments of the present invention can include various sunshade components all made from extruded aluminum alloy which can be anodized to have a consistent visual appearance. The present invention is not limited to anodized finishing and can be practiced with any other suitable finish, for example paint and mill finish. Also, the present invention can be practiced using materials other than extruded aluminum.

Existing installation of sunshade assemblies can also have difficulties and problems and can be improved. Multiple sunshades are typically installed in a sequential order in which each sunshade assembly is hoisted and then attached to the anchor clips. With most sunshades, the bolts that hold the sunshade assemblies in place can only be partially engaged until the adjacent sunshade is also positioned in the anchor clips. At that time the bolts can be fully engaged at the adjacent sides of the last two sunshades and only partially engaged at the other end of the last sunshade assembly. As the next sunshade is positioned, the partially engaged bolts can then be fully engaged and the bolts at the opposite side only partially engaged. This process continues until the entire sunshade array is installed. Partially engaging various bolts during the sunshade installation process can be cumbersome and safety may be a concern during installation of the sunshades.

Pressure plates are required to attach sunshades to certain curtain wall structures, such as outside-glazed curtain walls, which is the most common type of curtain wall. The pressure plate is typically custom machined to accommodate the attachment of the anchor clip. It is important that machined holes or notches in the pressure plate be located in the exact position along the pressure plate prior to installation in order to properly align the sunshade array. Often times the pressure plates are in excess of twenty feet long and may be used across two stories of the building, and thus, used for two arrays of sunshades. If machining of the pressure plate is slightly incorrect, installation will be significantly compromised and the part must be scrapped.

Therefore, improvements can be made to sunshades and related methods, including methods of installing sunshades.

Accordingly, needs exist to improve sunshades and related methods, including methods of installing sunshades, for the reasons mentioned above and for other reasons.

SUMMARY OF THE INVENTION

The present invention provides new sunshades, sunshade components and related methods. In an embodiment of the present invention, a sunshade can be attached to a curtain wall or other building framing system of a building structure. The sunshade can not only provide the positive benefits of shading the building but is also an improvement over existing sunshades. Furthermore, the sunshades allow for improved methods of installation.

In an embodiment of the present invention, a sunshade for mounting to a building structure has first and second outriggers spaced apart from each other, and a light passage inhibiting member extending from the first outrigger to the second outrigger. At least one of the first and second outriggers has an elongated body, an upper leg extends from an upper portion of the elongated body, and a lower leg extends from a lower portion of the elongated body.

At least one of the upper and lower legs may extend along substantially an entire longitudinal length of the elongated body. The upper and lower legs may extend in a direction away from the light passage inhibiting member. At least one of the upper and lower legs may extend at about a right angle from an outer end of the respective upper and lower portions.

The sunshade may also have a spacer slidably engaged with one of the first and second outriggers and slidable in a longitudinal direction of the outrigger. The outrigger having the spacer may have a spacer mounting recess, and the spacer may have a projection extending into the spacer mounting recess and slidable along the spacer mounting recess. The outrigger may have a pair of spacer mounting recesses, in which one spacer mounting recess is located proximate the upper leg and another spacer mounting recess located proximate the lower leg, and the spacer may have a pair of projections, each projection extending into and slidable along one of the pair of spacer mounting recesses.

The spacer may have a body and a plurality of legs extending from the body.

The outrigger may have a mounting notch extending inward into the outrigger from an outer edge of the outrigger. The mounting notch may have an L-shape. The outrigger may be extruded.

The light passage inhibiting member may be a plurality of louvers.

In an embodiment of the present invention, a sunshade array for mounting to a building structure has first and second sunshades adjacent each other. Each one of the first and second sunshades has a building mounting side, a cantilever side opposite the building mounting side, and first and second opposite ends extending between the building mounting side and the cantilever side. The first and second sunshades are adjacent each other such that the first end of the first sunshade and the second end of the second sunshade face each other and form a pocket between the first end of the first sunshade and the second end of the second sunshade. A connector is positioned within the pocket substantially at the cantilever sides of the first and second sunshades. The connector is engaged with the first end of the first sunshade and the second end of the second sunshade and holds the first and second sunshades together in a desired alignment.

The sunshade array may provide that the first end of the first sunshade and the second end of the second sunshade each have an outrigger. Each outrigger may have an elongated body, an upper leg extending from an upper portion of the elongated body and having an upper leg end face, and a lower leg extending from a lower portion of the elongated body and having a lower leg end face. The upper leg end faces of the upper legs are adjacent each other, and the lower leg end faces of the lower legs are adjacent each other which forms the pocket.

The sunshade array may provide that each outrigger has a recess open to the pocket and extends inwardly into the outrigger. Also, the connector may have projections extending into the recesses.

The sunshade array may provide that a spacer is positioned within the pocket substantially at the building mounting sides of the first and second sunshades. The connector may be engaged with the first end of the first sunshade and in contact with the second end of the second sunshade.

In an embodiment of the present invention, a method of mounting sunshades to a building structure provides positioning a first sunshade assembly adjacent first and second sunshade anchors mounted to the building structure; aligning a slot in an end of a first outrigger of the first sunshade assembly with a hanger hook of the first sunshade anchor; moving the first sunshade toward the first anchor such that the slot in the end of the first outrigger slidingly receives the hanger hook of the first sunshade anchor; aligning a slot in an end of a second outrigger of the first sunshade assembly with a hanger hook of the second sunshade anchor; moving the first sunshade toward the second anchor such that the slot in the end of the second outrigger slidingly receives the hanger hook of the first sunshade anchor; and securely fastening the first and second outriggers to the first and second anchors, respectively.

The method of mounting sunshades to a building structure may provide for sliding the slot on the hanger hook in a generally horizontal direction and subsequently sliding the slot on the hanger hook in a generally downward direction.

The method of mounting sunshades to a building structure may provide for installing a bolt in the first anchor to define the hanger hook of the first anchor.

The method of mounting sunshades to a building structure may provide for sliding a spacer engaged with the first outrigger toward the first sunshade anchor.

The method of mounting sunshades to a building structure may provide for mounting a second sunshade to the first sunshade anchor and to a third sunshade anchor mounted to the building structure; inserting a connector into engagement with cantilevered ends of the first outrigger and an outrigger of the second sunshade; and holding the first and second sunshades in a desired alignment by the engagement of the connector with the cantilevered ends.

In an embodiment of the present invention, an outrigger for a building sunshade has an elongated body having a building mounting end portion and a cantilever end portion opposite the building mounting end portion. A mounting notch extends inward into the elongated body from an outer edge of the building mounting end portion.

The mounting notch may have an L-shape.

The outrigger may also have an upper leg extending from an upper portion of the elongated body, and a lower leg extending from a lower portion of the elongated body. At least one of the upper and lower legs may extend along substantially an entire longitudinal length of the elongated body. At least one of the upper and lower legs may extend at about a right angle from an outer end of the respective upper and lower portions. The outrigger may also have a first recess located proximate the upper leg and extending in a longitudinal direction of the outrigger, and a second recess located proximate the lower leg and extending in the longitudinal direction of the outrigger.

Features of the present invention are described in certain sunshade embodiments. However, the present invention is broader than the described embodiments. Embodiments of the present invention may have various features and provide various advantages. Any of the features and advantages of the present invention may be desired, but, are not necessarily required to practice the present invention.

Advantages of the present invention can be to provide new sunshades.

Another advantage of the present invention can be to provide new methods related to sunshades, such as new methods of installing sunshades.

Another advantage of the present invention can be to provide new sunshade components, for example, new outriggers, spacers and connectors.

A further advantage of the present invention can be to provide new pressure plates used on curtain walls for mounting sunshades to the curtain walls.

Yet another advantage of the present invention can be to simplify the installation of sunshades on building curtain walls or other building framing system.

Additional features and advantages of the present invention are described in, and will be apparent from, the following Detailed Description of the Invention and the figures.

DETAILED DESCRIPTION OF THE INVENTION

Figure 1:
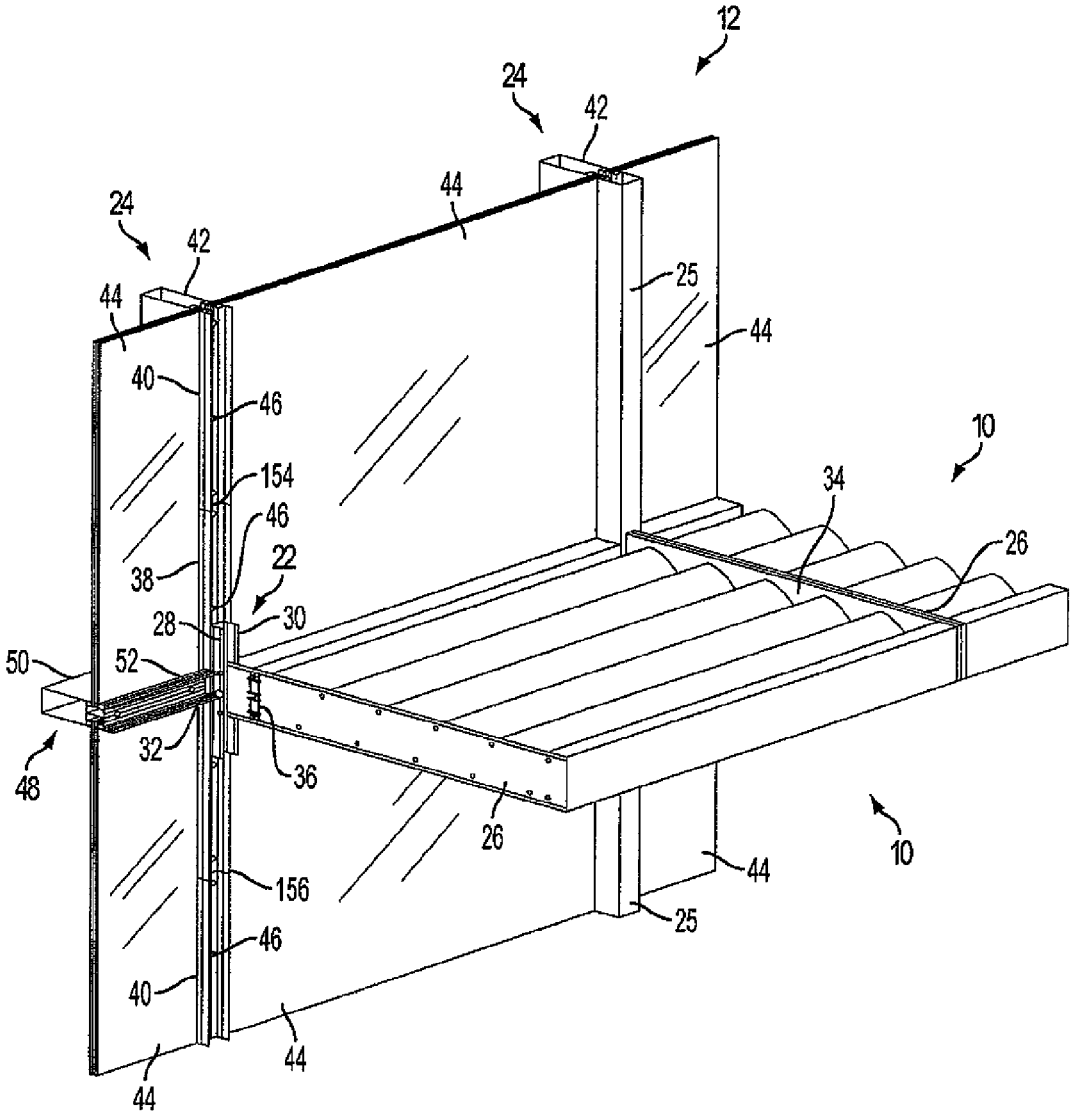
FIG. 1 is a perspective view of a sunshade according to the present invention mounted to a curtain wall.
Figure 2:
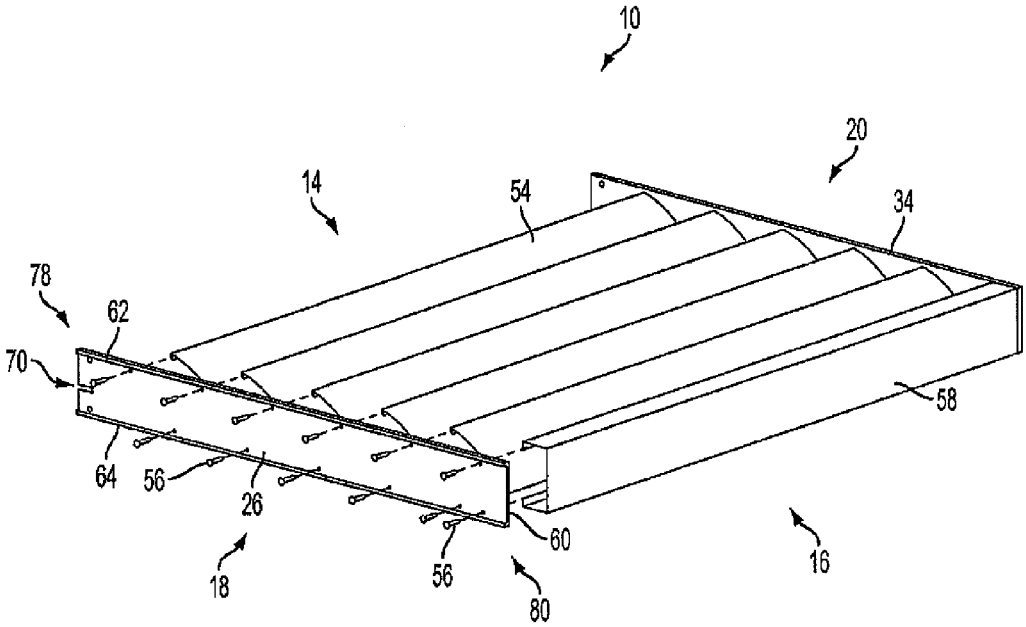
FIG. 2 is a partially exploded, perspective view of the sunshade.
Figure 3:
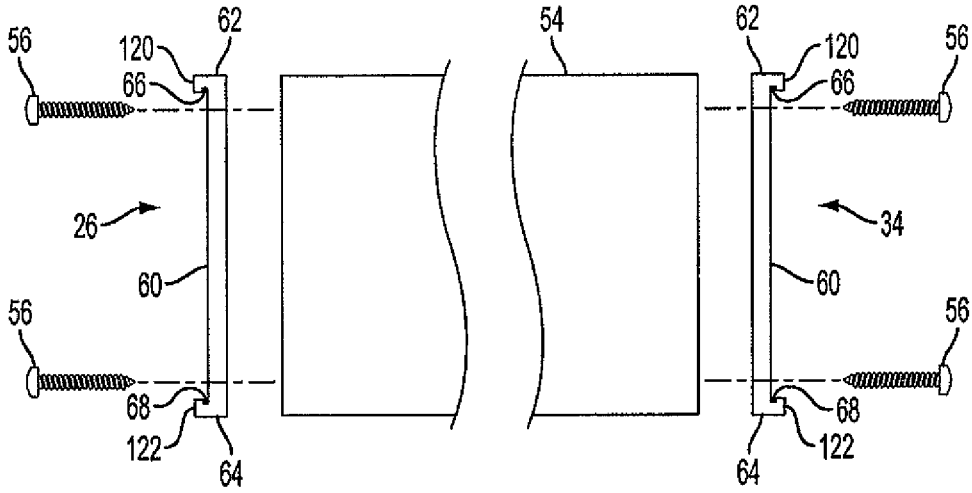
FIG. 3 is an exploded front view of the sunshade.

One example of a sunshade 10 according to the present invention is shown in FIGS. 1-3. The sunshade 10 is shown in FIG. 1 as partially installed on a curtain wall 12 of a building structure. The sunshade 10 reduces the amount of sunlight reaching the building structure by inhibiting passage of sunlight through the sunshade 10. A portion of a second sunshade 10 is also shown in FIG. 1 on the curtain wall 12 of the building structure. A plurality of sunshades 10, such as the two sunshades 10, 10 of FIG. 1, form a sunshade array. Each sunshade 10 is securely fastened in a cantilevered manner to the curtain wall 12 with sufficient strength to overcome at least combined wind loads, dead loads and snow loads applied to the sunshade 10. Referring also to FIG. 2, each sunshade 10 has a building mounting side 14 which is mounted to the curtain wall 12 of the building structure and a cantilever side 16 opposite the building mounting side 14. First and second opposite ends 18, 20 of each sunshade 10 extend between the building mounting side 14 and the cantilever side 16 of the sunshade 10.

Referring to FIG. 1, the sunshade 10, which is typically orientated horizontally on the building, is attached to two sunshade anchors 22 which are mounted to two spaced-apart vertical mullions 24. A mullion cover 25 is removed from the left vertical mullion 24 to show the sunshade anchor 22. The right vertical mullion 24 is shown with the mullion cover 25 in place which hides the right sunshade anchor 22 from view. The sunshade anchors 22 are the thermally broken sunshade anchors described in detail in the copending parent application. However, the present invention can be practiced using other sunshade anchors as well. FIG. 1 shows an outrigger 26 of the sunshade 10 mounted to the left sunshade anchor 22. The outrigger 26 is attached to arms 28, 30 of the sunshade anchor 22 by fasteners. Only one fastener 32 is shown in FIG. 1 as holding the outrigger 26 on the left sunshade anchor 22. When another sunshade 10 is installed, then three fasteners will be installed and tightened to mount adjacent outriggers to the left sunshade anchor 22. The right outrigger 34 of the sunshade 10 is similarly attached to the right sunshade anchor 22 (covered by the mullion cover 25).

A spacer 36 is also shown in FIG. 1 on the left outrigger 26. Prior to installation of the next sunshade 10, the spacer 36 will be moved into its installation position between the arms 28, 30 of the sunshade anchor 22 and between the adjacent outriggers. The spacer 36 is further described below.

As shown in FIG. 1, the left vertical mullion 24 of the curtain wall 12 has a notched pressure plate 38 and pressure plates 40 mounted to an interior mullion member 42 on opposite sides of glass panels 44. The right vertical mullion 24 also has a notched pressure plate 38 and pressure plates 40 which are covered by the mullion cover 25. The notched pressure plates 38 and the pressure plates 40 are components of the curtain wall 12 that capture the glass panels 44, i.e., an external glass capture member. Gaskets are provided between the notched pressure plates 38 and the glass panels 44, and between the pressure plates 40 and the glass panels 44. Gaskets are also provided between the glass panels 44 and the interior mullion members 42. Fasteners 46 securely mount the notched pressure plates 38, the pressure plates 40, the glass panels 44, the gaskets, and the interior mullion members 42 together. Horizontal mullions 48 are constructed similar to the vertical mullions 24. The curtain wall 12 includes the vertical mullions 24, the horizontal mullions 48, the glass panels 44, and the gaskets. The vertical mullions 24 include the interior mullion member 42 and the exterior pressure plates 38, 40. The horizontal mullions 48 include an interior mullion member 50 and an exterior pressure plate 52. However, the present invention can be practiced with other curtain walls having structures different than the curtain wall 12. For example, the present invention can be practiced with other curtain walls that have glass capture members that are different than the pressure plates 38, 40, 52. The present invention can also be practice with other building framing systems and other structural supports. The notched pressure plate 38 is also further described below.

Referring to FIGS. 1-3, the sunshade 10 has the left and right (first and second) outriggers 26, 34, which are spaced apart from each other, and a light passage inhibiting member 54 extending from the first outrigger 26 to the second outrigger 34. The light passage inhibiting member 54 reduces or blocks the amount of light that would otherwise reach the building structure. One example of the light passage inhibiting member 54 is a plurality of louvers. The louvers 54 can be mounted to the first and second outriggers 26, 34 by fasteners 56 or other suitable attachment methods. The louvers 54 are made of extruded aluminum, although the louvers and/or the light passage inhibiting member 54 can be made using other materials as desired.

The sunshade 10 can also have a fascia 58, if desired. The fascia 58 is attached to the left and right outriggers 26, 34 at the cantilever side 16 of the sunshade 10. The fascia 58 is made of extruded aluminum, although the fascia can be made using other materials as desired.

The first (left) outrigger 26 has an elongated body 60, an upper leg 62 extending from an upper portion of the elongated body 60, and a lower leg 64 extending from a lower portion of the elongated body 60. The upper and lower legs 62, 64 extend along substantially the entire longitudinal length of the elongated body 60. However, either one or both of the upper and lowers legs 62, 64 could extend along only a portion of the longitudinal length of the elongated body 60 or intermittently along the longitudinal length of the elongated body 60. Referring to FIG. 3, the upper and lower legs 62, 64 extend from the elongated body 60 in a direction away from the louvers 54 or the light passage inhibiting member. The upper leg 62 extends at about a right angle from an outer end of the upper portion, and, similarly, the lower leg 64 extends at about a right angle from an outer end of the lower portion.

Referring to FIG. 3, the first outrigger 26 also has a first recess 66 located proximate the upper leg 62 and a second recess 68 located proximate the lower leg 64. The first and second recesses 66, 68 extend in a longitudinal direction of the outrigger 26. The first and second recesses 66, 68 may extend along substantially the entire length of the first outrigger 26 or only a portion of the first outrigger 26. The first and second recesses 66, 68 are spacer mounting recesses as will be further explained below.

Figure 4:
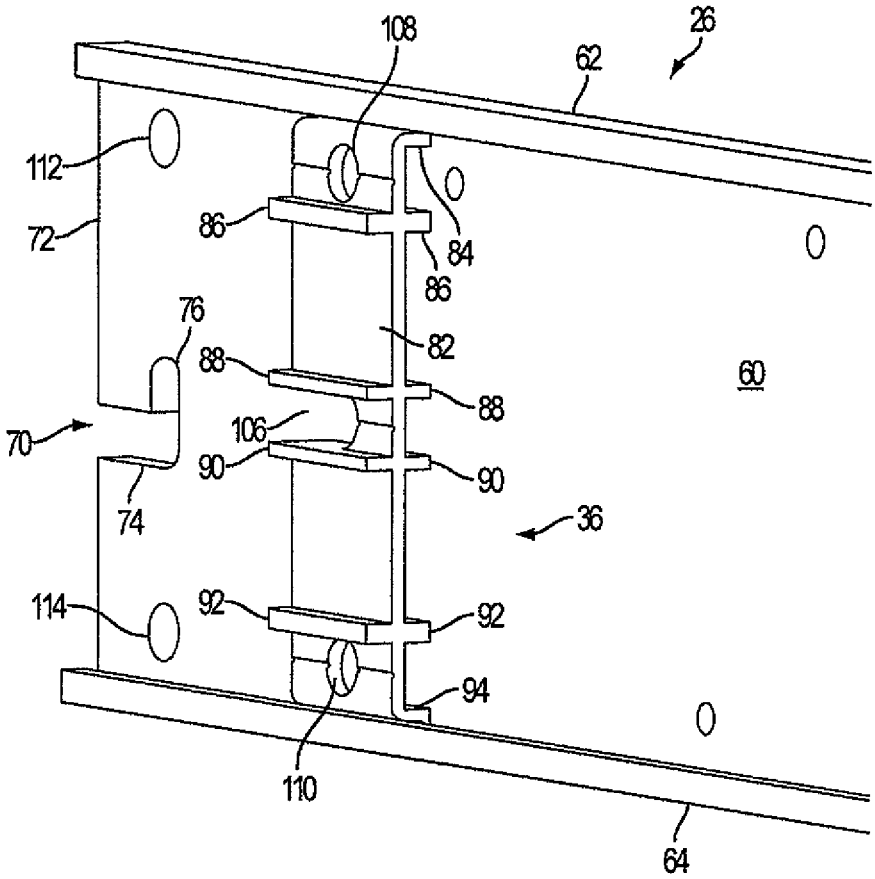
FIG. 4 is a perspective view of a portion of an outrigger and a spacer of the sunshade.

Referring to FIG. 4, the first outrigger 26 has a mounting notch 70 extending inward into the first outrigger 26 from an outer edge 72 of the first outrigger 26. As shown in FIG. 4, the mounting notch 70 has an L-shape with one leg 74 of the L-shape extending generally horizontally into the outrigger 26 and the other leg 76 extending upwardly or vertically. However, the mounting notch 70 could have other shapes as desired. The mounting notch 70 allows the sunshade 10 to be hung on and supported by the sunshade anchors 22. Referring to FIGS. 1 and 2, the elongated body 60 of the first outrigger 26 has a building mounting end portion 78 which mounts to the curtain wall 12 of the building structure, and a cantilever end portion 80 opposite the building mounting end portion 78. The mounting notch 70 of the elongated body 60 is located at the building mounting end portion 78 of the elongated body 60 of the first outrigger 26.

The second (right) outrigger 34 has the same structure as the first (left) outrigger 26. Except, the upper and lower legs 62, 64 extend from the elongated body 60 of the second outrigger 34 in an opposite direction relative to the direction of the upper and lower legs 62, 64 of the first outrigger 26, as can be seen in FIG. 3. The first and second outriggers 26, 34 are made of extruded aluminum, although the first and second outriggers 26, 34 can be made using other materials as desired.

Figure 8:
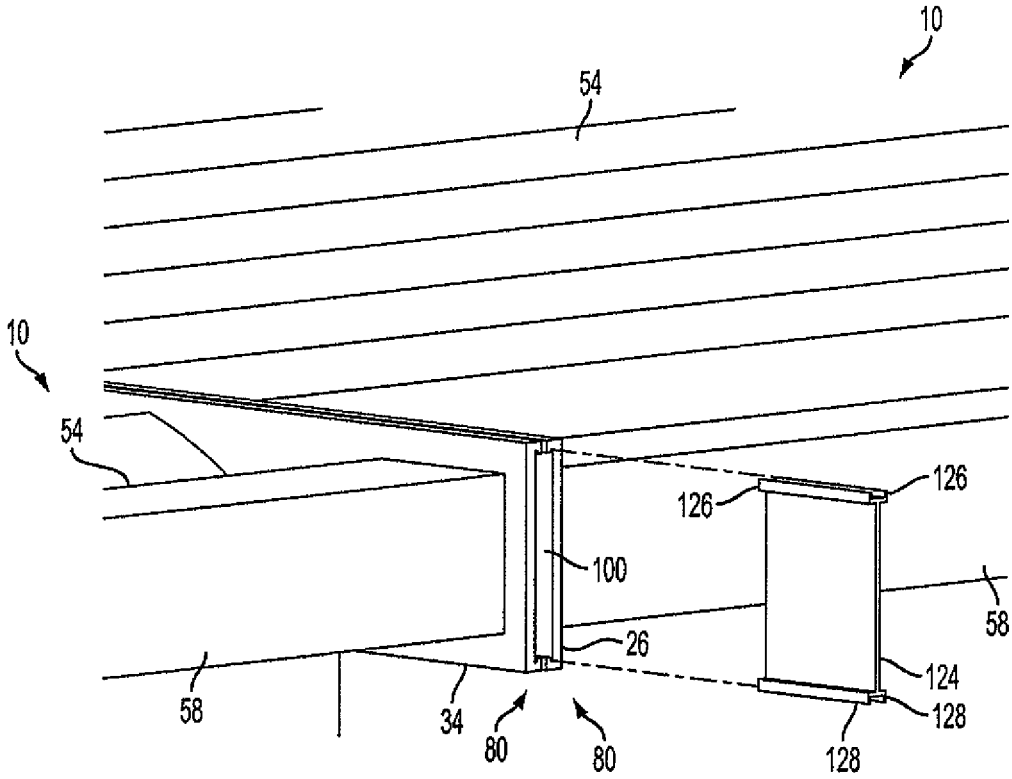
FIG. 8 is an exploded perspective view of a connector prior to installation and engagement with adjacent sunshades.

Referring to FIGS. 1, 2 and 8, the adjacent outriggers 34, 26 of adjacent sunshades 10, 10 have a structure which conceals the fasteners 56 that mount the louver blades 54 to the outriggers 34, 26. This provides improved visual features of the sunshade 10 and the sunshade array.

Figure 5:
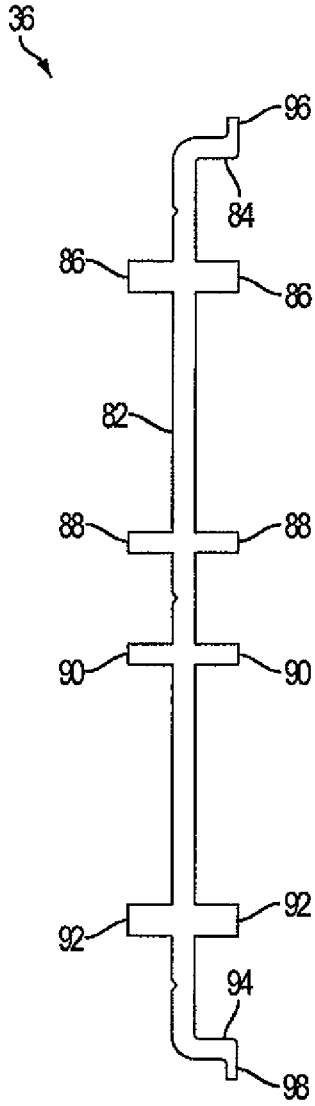
FIG. 5 is a front view of the spacer of FIG. 4.

Referring to FIGS. 4 and 5, the sunshade 10 has a spacer 36 slidably engaged with the first outrigger 26. The spacer 36 has a body 82 and a plurality of legs 84, 86, 88, 90, 92, 94 extending from the body 82. The spacer 36 has a pair of projections 96, 98, such as the projections on the uppermost and lowermost legs 84, 94. The projections 96, 98 extend into the spacer mounting recesses 66, 68 of the first outrigger 26 when the spacer. 36 is slidably engaged with the first outrigger 26. The projections 96, 98 on the spacer 36 and the spacer mounting recesses 66, 68 (FIG. 3) of the first outrigger 26 allow the spacer 36 to slide in a longitudinal direction of the first outrigger 26, and retain the spacer 36 on the first outrigger 26. The spacer 36 can be slid onto and off of the first outrigger 26 at the open ends of the first outrigger 26, i.e. the building mounting end portion 78 and the opposite cantilever end portion 80. The spacer 36 and the outrigger 26 allow the spacer 36 to be pre-assembled onto the outrigger 26 if desired. Also, the spacer 36 is easily handled and placed into its installation position (described below) by sliding the spacer 36. This helps to significantly reduce or eliminate mishandling of the spacer 36 and to ensure proper positioning of the spacer 36. The spacer 36 fills a gap or pocket between adjacent outriggers 34, 26 when the adjacent outriggers 34, 26 are mounted to a common sunshade anchor 22. The pocket between the adjacent outriggers 34, 26 is shown in FIG. 8 at the cantilevered end portions 80, 80 of the adjacent outriggers 34, 26 as pocket 100. The pocket 100 extends along the longitudinal length of the adjacent outriggers 34, 26.

Figure 6:
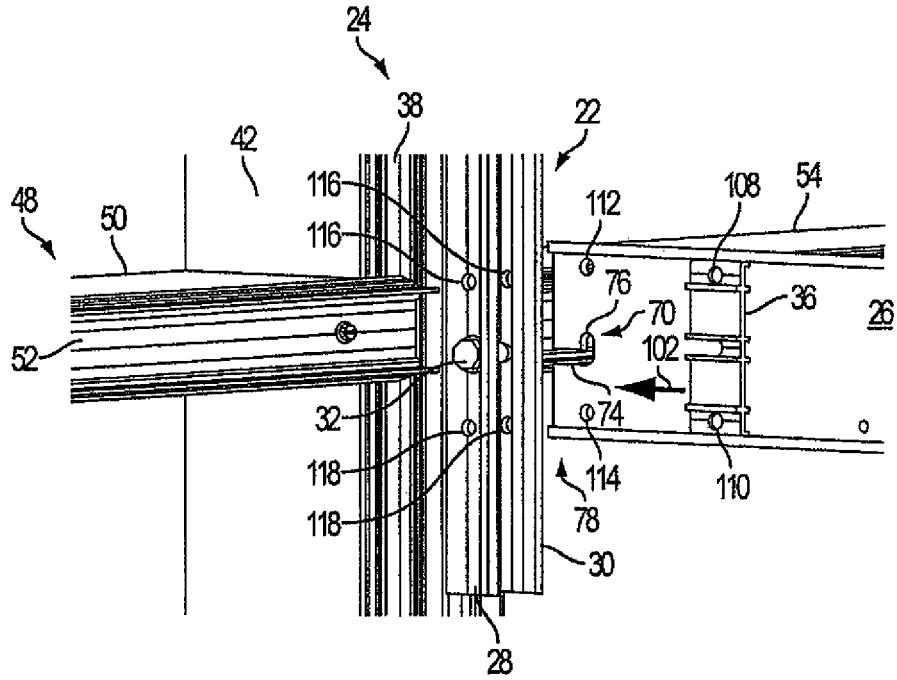
FIG. 6 is a perspective view of the sunshade during a process of being mounted to an anchor clip.

An example of mounting the sunshade 10 to the curtain wall 12 of the building structure will now be described. Referring to FIG. 1, the sunshade 10 is mounted to the two sunshade anchors 22, 22 which are mounted to the vertical mullions 24, 24 of the curtain wall 12. FIG. 1 only shows one sunshade anchor 22 as the other sunshade anchor 22 is covered by the mullion cover 25. Referring to FIG. 6, the left sunshade anchor 22 is shown installed on the vertical mullion 24. A bolt (fastener) 32 is installed through the middle bolt holes of the left and right arms 28, 30 of the sunshade anchor 22 and retained on the sunshade anchor 22 by a nut (not shown). The bolt 32 will function as a hanger hook for the sunshade 10. A bolt 32 is also installed on the other (right) sunshade anchor 22 in the same manner (the right sunshade anchor 22 is covered by the vertical mullion cover 25 in FIG. 1).

Referring to FIGS. 1 and 6, the sunshade 10 is installed by being hoisted and positioned adjacent the left and right (first and second) sunshade anchors 22, 22 mounted to the curtain wall 12. As shown in FIG. 6, the mounting notch or slot 70 in the building end portion 78 of the first outrigger 26 of the sunshade 10 is aligned with the hanger hook 32 of the first sunshade anchor 22. The sunshade 10 is moved toward the first sunshade anchor 22 such that the mounting notch 70 in the end of the first outrigger 26 slidingly receives the hanger hook 32 of the first sunshade anchor 22. The leg 74 of the mounting notch 70 is slid on the hanger hook 32 in a generally horizontal direction as shown by the arrow 102 in FIG. 6. Subsequently, the leg 76 of the mounting notch 70 is slid on the hanger hook 32 in a generally downward direction. The same procedure is performed on the right-hand side of the sunshade 10 such that the second outrigger 34 is hung on the other sunshade anchor 22. With the sunshade 10 hanging on the left and right sunshade anchors 22, 22 as just described, the sunshade 10 is in a temporary installation position and the full weight of the sunshade 10 can be supported by the curtain wall 12.

Figure 7:
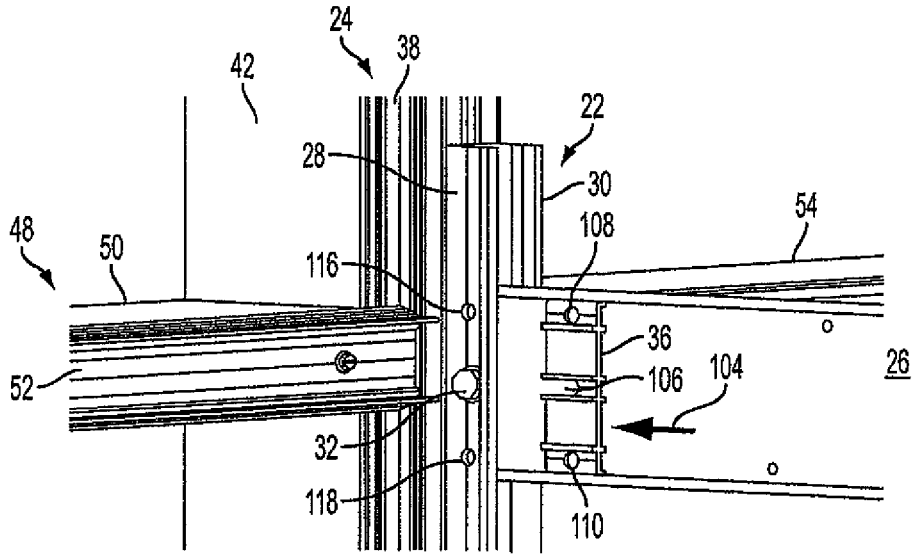
FIG. 7 is another perspective view of the sunshade during a process of being mounted to an anchor clip.

Referring to FIGS. 1 and 7, the spacer 36, which is engaged with the first outrigger 26, is slid in the direction of the arrow 104 in FIG. 7 toward the first sunshade anchor 22. The spacer 36 slides along the first outrigger 26 and is retained on the first outrigger 26 due to the projections 96, 98 on the uppermost and lowermost legs 84, 94 (FIG. 5) extending into and sliding along the spacer mounting recesses 66, 68 (FIG. 3) of the first outrigger 26. A notch 106 in the spacer 36 is provided for the hanger hook (bolt) 32 installed through the middle bolt holes of the left and right arms 28, 30 of the sunshade anchor 22. The upper and lower holes 108, 110 in the spacer 36 are aligned with corresponding upper and lower holes 112, 114 in the first outrigger 26 and upper and lower holes 116, 118 in the left and right arms 28, 30 of the sunshade anchor 22. See also, FIGS. 4 and 6. The spacer 32 can be installed onto the first outrigger 26 from either end 78, 80 of the first outrigger 26 prior to hanging the first outrigger 26 on the sunshade anchor 22. Also, the spacer 36 can be installed onto the first outrigger 26 from the cantilevered end 80 of the first outrigger 26 after the first outrigger 26 is hung on the sunshade anchor 22.

If another sunshade 10 is to be installed on the curtain wall 12 adjacent to the sunshade 10 already hanging on the curtain wall 12, then the next sunshade 10 is hung on the curtain wall 12 in the same manner as the previous sunshade 10. The right side outrigger 34 of the next sunshade 10 is hung on the same sunshade anchor 22 which has the left side outrigger 26 of the previous sunshade 10.

Referring to FIG. 8, the outriggers 34, 26 of the adjacent sunshades 10, 10 hanging on the curtain wall 12 (FIG. 1) are facing each other and form the pocket 100 between the outriggers 34, 26. More specifically, and also referring to FIG. 3, the upper leg end faces 120, 120 of the upper legs 62, 62 of the two outriggers 34, 26 face each other and are adjacent each other. Similarly, the lower leg end faces 122, 122 of the lower legs 64, 64 of the two outriggers 34, 26 face each other and are adjacent each other. The pocket 100 is formed between the two outriggers 34, 26. A connector 124 is inserted into the pocket 100 and into engagement with the cantilevered ends 80, 80 of the two adjacent outriggers 34, 26 of the two adjacent sunshades 10, 10. The connector 124 has upper projections 126, 126 and lower projections 128, 128 which extend into the upper recesses 66, 66 and the lower recesses 68, 68, respectively, of the outriggers 34, 26. The adjacent sunshades 10, 10 are held together in a desired alignment by the engagement of the connector 124 with the cantilevered ends 80, 80 of the outriggers 34, 26. The connector 124 can reduce or even eliminate the need to visually align adjacent sunshades 10, 10 when the sunshades 10, 10 are finally bolted to the sunshade anchors 22, 22. The connector 124 also helps prevent the cantilevered ends 80, 80 of the adjacent sunshades 10, 10 from becoming misaligned over time, for example, due to the adjacent sunshades 10, 10 sagging relative to each other. Accordingly, the structures of the outriggers 34, 26 allow for significant improvement to the installation of the sunshades 10, 10. Adhesive, sealant or other fastening methods can also be used where desired, for example to maintain the connector 124 at a particular location in the pocket 100.

Referring to FIGS. 1 and 6-8, the adjacent outriggers 34, 26 hanging on the same hanger hook 32 are securely fastened to the sunshade anchor 22. Bolts (fasteners) are inserted through the upper and lower bolt holes 116, 116, 118, 118 of the left and right arms 28, 30 of the sunshade anchor 22, through the upper and lower bolt holes 108, 110 of the spacer 36, and through the upper and lower bolt holes 112, 112, 114, 114 of the adjacent outriggers 34, 26. (See the bolts 130 in FIG. 9.) The three fastener bolts 32, 130, 130 are tightened to nuts to securely mount the adjacent outriggers 34, 26 and the adjacent sunshades 10, 10 to the curtain wall 12. The upper and lower bolts 130, 130 can be installed at any desired time during the installation process of the sunshade array because the individual sunshades 10 hang on the hanger hooks 32 of the sunshade anchors 22. Referring to FIG. 1, the sunshade 10 on the left-hand side of the figure is in a temporary installation position because the spacer 36 has not yet been slid to its installation position and because the upper and lower bolts 130, 130 have not been installed on the left side sunshade anchor 22. The ability of the sunshade 10 to be in the temporarily installation position greatly simplifies handling of the sunshades 10 and the installation process because of increased flexibility as to when the upper and lower bolts 130, 130 are installed.

Figure 9:
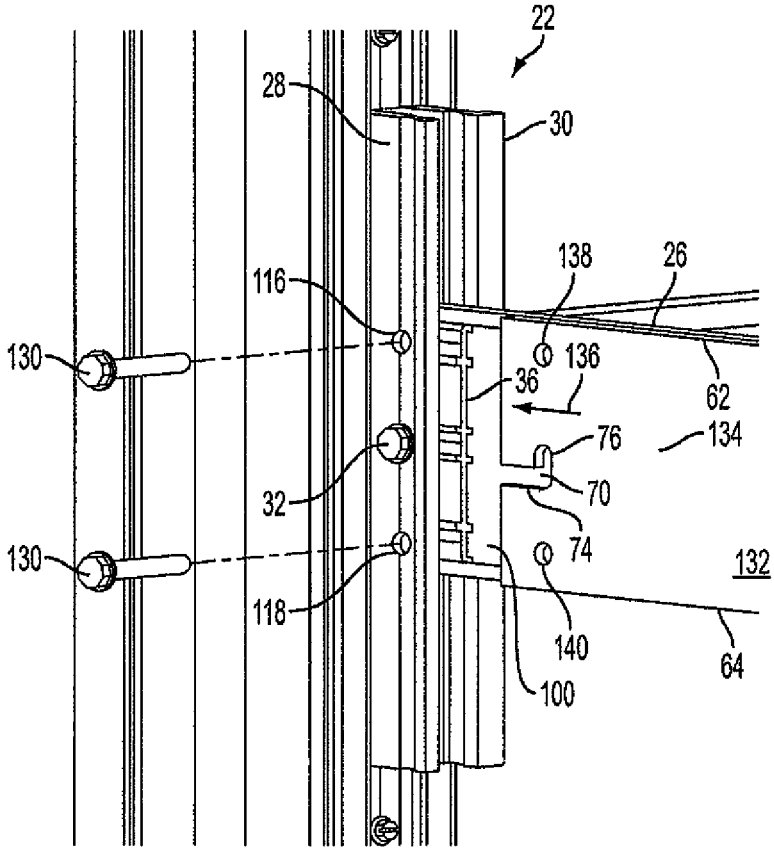
FIG. 9 is a perspective view of an end bay outrigger being installed on the sunshade.
Figure 10:
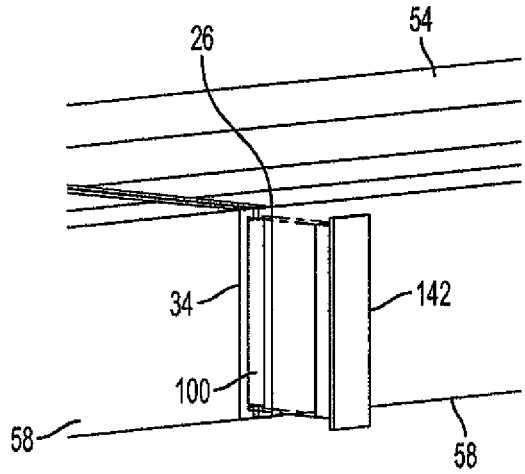
FIGS. 10 and 11 shows an end cap usable with the sunshade.
Figure 11:
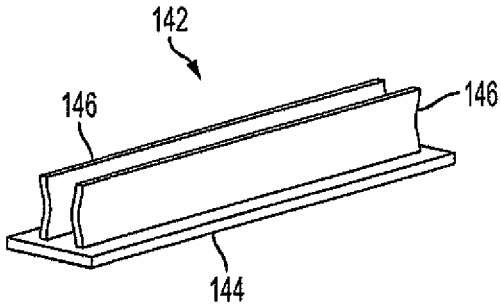

Referring to FIG. 9, if another sunshade 10 is not going to be installed on the curtain wall 12 adjacent to the sunshade 10 already hanging on the curtain wall 12, then an end bay outrigger 132 (trim piece covering the outrigger 26) can be installed adjacent the outrigger 26. The end bay outrigger 132 has a similar structure as the outrigger 34, including an elongated body 134, and upper and lower legs 62, 64 extending from upper and lower portions of the elongated body 134, respectively. A spacer 36 is provided in the pocket 100 between the outrigger 26 and the end bay outrigger 132. The spacer 36 is slid between the left and right arms 28, 30 of the sunshade anchor 22 into the installation position shown in FIG. 9, similar to the installation position of the spacer 36 when the spacer 36 is used between two adjacent outriggers 34, 26. The end bay outrigger 132 has a mounting notch 70 as in the outriggers 34, 26. The end bay outrigger 132 is installed by being positioned adjacent the left sunshade anchor 22 mounted to the curtain wall 12. The mounting notch or slot 70 in the end of the end bay outrigger 132 of the sunshade 10 is aligned with the hanger hook (bolt fastener) 32 of the first sunshade anchor 22. The end bay outrigger 132 is moved toward the first anchor 22 such that the mounting notch 70 in the end of the end bay outrigger 132 slidingly receives the hanger hook 32 of the first sunshade anchor 22. The leg 74 of the mounting notch 70 is slid on the hanger hook 32 in a generally horizontal direction as shown by the arrow 136 in FIG. 9. Subsequently, the leg 76 of the mounting notch 70 is slid on the hanger hook 32 in a generally downward direction. A connector 124 (FIG. 8) can be inserted into the pocket 100 between the outrigger 26 and the end bay outrigger 132 as with adjacent outriggers 34, 26. The connector 124 engages the outrigger 26 and the end bay outrigger 132 and holds them in proper alignment. Referring mainly to FIG. 9 and also to FIG. 6, bolts (fasteners) 130, 130 are inserted through the upper and lower bolt holes 116, 116, 118, 118 of the left and right arms 28, 30 of the sunshade anchor 22, through the upper and lower bolt holes 138, 140 of the end bay outrigger 132, through the upper and lower bolt holes 108, 110 of the spacer 36, and through the upper and lower bolt holes 112, 114 of the outrigger 26. The three fastener bolts 32, 130, 130 are tightened to nuts to securely mount the adjacent outrigger 26 and end bay outrigger 132 and the sunshade 10 to the curtain wall 12 (FIG. 1). Referring to FIGS. 1, 2, 3 and 9, the same procedure is performed on the right-hand side end 20 of the sunshade 10 such that another end bay outrigger 132 is hung on the other sunshade anchor 22. The same spacer 36 can be used on the right-hand side end 20 of the sunshade 10 by being inserted into spacer sliding recesses 66, 68 in the right-hand end bay outrigger 132. Alternatively, another spacer, similar to the spacer 36, except that the uppermost and lowermost legs 84, 94 extend in the opposite direction can be used. The alternative spacer can be slidingly engaged on the right-hand outrigger 34 in the recesses 66, 68.

Referring to FIGS. 2 and 9, the end bay outrigger 132 has a structure which cooperates with the outrigger 26 to conceal the fasteners 56 that mount the louver blades 54 to the outrigger 26. This provides improved visual features of the sunshade 10 and the sunshade array.

Referring to FIGS. 1, 3, 10 and 11, an end cap 142 can be inserted into the pocket 100 between adjacent outriggers 34, 26. The end cap has a face portion 144 and a pair of legs 146, 146 extending from the face portion 144. The pair of legs 146, 146 are inserted into the recesses 66, 66, 68, 68 of the adjacent outriggers 34, 26. Adhesive, sealant or other fastening methods can also be used where desired, for example to maintain the end cap 142 in the pocket 100. An end cap 142 can similarly be inserted in the pocket 100 between an outrigger 26 and an end bay outrigger 132.

Figure 12:
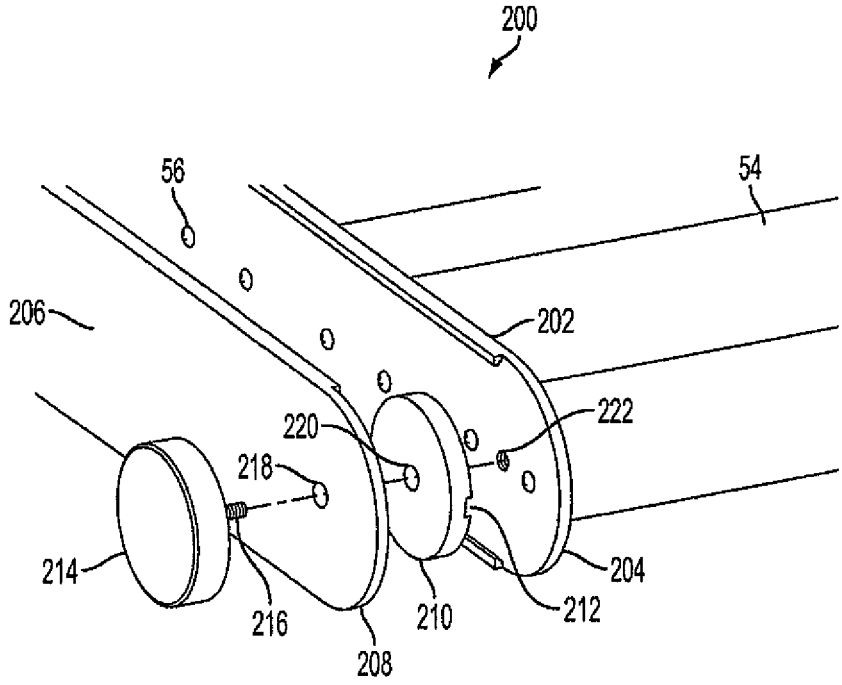
FIG. 12 is a partially exploded, perspective view of a portion of another sunshade according to the present invention.
Figure 13:
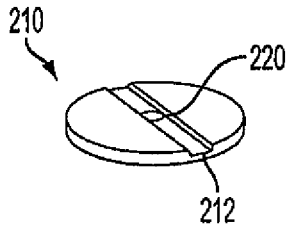
FIG. 13 is a perspective view of a spacer of FIG. 12.

Referring to FIGS. 12 and 13, a portion of another sunshade 200 according to the present invention is shown. The sunshade 200 is similar to the sunshade 10 described above, except the outriggers have a different shape. The outrigger 202 has a rounded cantilever end 204 instead of a square corner shape cantilever end 80 of the outriggers 26, 34 (see FIG. 2). The end bay outrigger 206 also has a rounded cantilever end 208 instead of a square corner shape cantilever end. A medallion spacer 210 is provided at the cantilever ends 204, 208. The medallion spacer 210 has a notch 212 for the fasteners 56 so that the medallion spacer 210 can lie flat against the outrigger 202. A medallion 214 having a threaded fastener 216 can be used to secure the cantilever ends 204, 208 of the outrigger 202 and the end bay outrigger 206 together. The threaded fastener 216 of the medallion 214 extends through holes 218, 220 and is engaged with a threaded hole 222 in the outrigger 202. The sunshade 200 of FIGS. 12 and 13 is an alternative sunshade having a different decorative visual look. The present invention can also be practiced using outriggers having other shapes, for example, wedge shaped outriggers, outriggers which are curved along at least a portion of their longitudinal length, and square corner outriggers, such as the square corner outriggers 26, 34.

Figure 14:
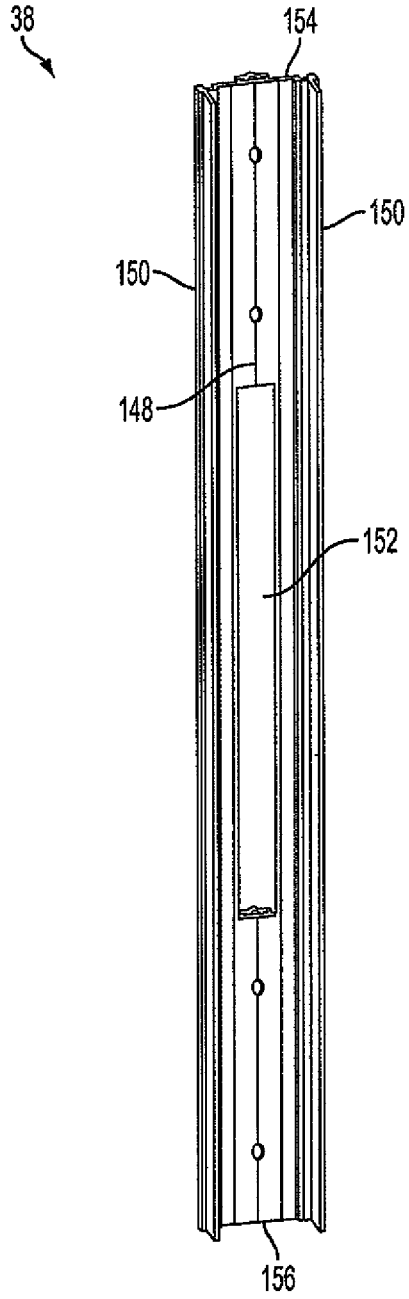
FIG. 14 is a perspective view of a pressure plate according to the present invention.

Referring to FIGS. 1 and 14, a notched pressure plate 38 according to the present invention is shown. As shown in FIG. 1, the notched pressure plate 38 is an exterior mullion component which is mounted to the interior mullion member 42 of the vertical mullion 24 by fasteners 46. Referring also to FIG. 14, the notched pressure plate 38 has an elongated body portion 148 and a pair of legs 150, 150 extending from the body portion 148. The notched pressure plate 38 has a notch 152 through the body portion 148 which receives the sunshade anchor 22 and allows the sunshade anchor 22 to be mounted to the interior mullion member 42. One feature of the notched pressure plate 38 is that the notched pressure plate 38 has a relatively short, predetermined length from a top end 154 to a bottom end 156. In a particular embodiment, the predetermined, short length of the notched pressure plate 38 is about 3 feet, for example.

Referring to FIG. 1, the notched pressure plate 38 is installed such that the notch 152 is located at a desired position for the sunshade anchor 22 and the sunshade 10. The top end 154 of the notched pressure plate 38 extends only a short distance (about 1½ feet) above the sunshade anchor location and the bottom end 156 of the notched pressure plate 38 extends only a short distance (about 1½ feet) below the sunshade anchor location. In an embodiment, the notched pressure plate 38 extends along the vertical mullion 24 only a sufficient distance for mounting a single sunshade array and does not extend along the vertical mullion 24 to mount two sunshade arrays. The pressure plates 40 (FIG. 1) are provided above and below the notched pressure plate 38 and extend along the remainder of the length of the vertical mullion 24. The pressure plates 40 do not need to have a notch 152 because the pressure plates 40 are not used for mounting a sunshade anchor 22 or a sunshade 10. However, if a notch 152 or other notch is provided in the pressure plates 40, the notch can simply not be used for a sunshade anchor 22.

One advantage of the notched pressure plate 38 is that the processes of installing the notched pressure plate 38, the pressure plates 40 and sunshades 10 are simplified. The notched pressure plate 38 is easily installed such that the notch 152 for the sunshade anchor 22 is located at a desired location because of the short length of the notched pressure plate 38. Also, the notch 152 for the sunshade anchor 22 can be pre-machined in the notched pressure plate 38 without concern for precisely determining a notch location on an otherwise long pressure plate, for example in excess of 20 feet. After the notched pressure plate 38 is installed, the pressure plates 40 are easily cut to a proper length and then installed adjacent to the notched pressure plate 38, i.e. above and below the notched pressure plate 38. This greatly simplifies the processes of installing pressure plates and sunshades. Also, the risks of error and waste during installation of sunshades can be reduced.

Various components of the sunshades of the present invention can be made from the same extruded aluminum alloy. For example, the outriggers, louvers, end bay outriggers, fascias, end caps and other trim pieces can all be made by extrusion from the same alloy. Accordingly, the sunshades can be anodized to have a consistent visual effect. Also, the overall cost of the sunshade may be reduced because of simplified anodized finishing. The present invention is not limited to anodized finishing and can be practiced with any other suitable finish, for example paint and mill finish. Also, the present invention can be practiced using materials other than extruded aluminum.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A sunshade for mounting to a building structure, comprising:

first and second outriggers spaced apart from each other; and a light passage inhibiting member extending from the first outrigger to the second outrigger;

wherein at least one of the first and second outriggers has an elongated body, an upper leg extending from an upper portion of the elongated body, and a lower leg extending from a lower portion of the elongated body thereby creating a channel, and wherein the sunshade further comprises a spacer slidably engaged with an inner portion of the channel of the at least one of the first and second outriggers and slidable in a longitudinal direction of the at least one of the first and second outriggers, and wherein the channel formed by the upper leg and lower leg is disposed on a side of the at least one of the first and second outriggers that is opposite a side from which the light passage inhibiting member extends.

2. The sunshade of claim 1, wherein at least one of the upper and lower legs extends along substantially an entire longitudinal length of the elongated body.

3. The sunshade of claim 2, wherein the other one of the upper and lower legs extends along substantially the entire longitudinal length of the elongated body.

4. The sunshade of claim 3, wherein the upper and lower legs extend in a direction away from the light passage inhibiting member.

5. The sunshade of claim 1, wherein the upper and lower legs extend in a direction away from the light passage inhibiting member.

6. The sunshade of claim 1, wherein at least one of the upper and lower legs extends at about a right angle from an outer end of the respective upper and lower portions.

7. The sunshade of claim 1, wherein the at least one of the first and second outriggers has a spacer mounting recess extending in the longitudinal direction of the at least one of the first and second outriggers, and the spacer has a projection extending into the spacer mounting recess and slidable along the spacer mounting recess.

8. The sunshade of claim 7, wherein the spacer mounting recess is disposed in the upper leg or the lower leg.

9. The sunshade of claim 1, wherein the at least one of the first and second outriggers has a pair of spacer mounting recesses extending in the longitudinal direction, one spacer mounting recess located proximate the upper leg and another spacer mounting recess located proximate the lower leg, and wherein the spacer comprises a pair of projections, each projection extending into and slidable along one of the pair of spacer mounting recesses.

10. The sunshade of claim 1, wherein the spacer has a body and a plurality of legs extending from the body.

11. The sunshade of claim 1, wherein the first outrigger has a mounting notch extending inward into the first outrigger from an outer edge of the first outrigger.

12. The sunshade of claim 11, wherein the mounting notch has an L-shape.

13. The sunshade of claim 1, wherein the first and second outriggers are extruded.

14. The sunshade of claim 1, wherein the light passage inhibiting member comprises a plurality of louvers.

15. The sunshade of claim 1, wherein the light passage inhibiting member is attached to the first and second outriggers by fasteners.

16. The sunshade of claim 1, wherein the light passage inhibiting member abuts the first and second outriggers.

* * * * *